US011004309B2

(12) United States Patent
Oyama et al.

(10) Patent No.: US 11,004,309 B2
(45) Date of Patent: May 11, 2021

(54) INFORMATION PROCESSOR

(71) Applicant: Universal Entertainment Corporation, Tokyo (JP)

(72) Inventors: Masaki Oyama, Tokyo (JP); Toshikazu Jinnouchi, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 0 days.

(21) Appl. No.: 16/553,794

(22) Filed: Aug. 28, 2019

(65) Prior Publication Data

US 2020/0082671 A1 Mar. 12, 2020

(30) Foreign Application Priority Data

Sep. 6, 2018 (JP) ..... JP2018-166661

(51) Int. Cl.
*G07F 17/34* (2006.01)
*G07F 17/32* (2006.01)

(52) U.S. Cl.
CPC ..... *G07F 17/3267* (2013.01); *G07F 17/3209* (2013.01); *G07F 17/3258* (2013.01); *G07F 17/34* (2013.01)

(58) Field of Classification Search
CPC ..... G07F 17/3267; G07F 17/3209; G07F 17/3258; G07F 17/34
See application file for complete search history.

(56) References Cited

U.S. PATENT DOCUMENTS

| | | | | |
|---|---|---|---|---|
| 9,272,213 | B2 | 3/2016 | Toyama | |
| 2009/0203425 | A1* | 8/2009 | Yoshizawa | G07F 17/32 463/20 |
| 2012/0309493 | A1* | 12/2012 | Osawa | A63F 13/10 463/20 |
| 2016/0042608 | A1* | 2/2016 | Inamura | G07F 17/3255 463/20 |
| 2016/0042610 | A1* | 2/2016 | Kitamura | G07F 17/3267 463/21 |
| 2016/0042614 | A1* | 2/2016 | Kojima | G07F 17/34 463/20 |
| 2017/0263082 | A1* | 9/2017 | Fujimori | G07F 17/3288 |

* cited by examiner

*Primary Examiner* — Omkar A Deodhar
*Assistant Examiner* — Shauna-Kay Hall
(74) *Attorney, Agent, or Firm* — Simpson & Simpson, PLLC; S. Peter Konzel

(57) ABSTRACT

The information processor executes the processes of: (a) setting a winning probability of second random determination based on a winning probability corresponding to a condition set by a setting unit which sets one of conditions associated with different winning probabilities; (b) determining whether to execute the first random determination by the second random determination based on the winning probability set in the process (a); (c) when a win is achieved in the second random determination in the process (b), executing the first random determination; and (d) when a result of the first random determination in the process (c) is different from a predetermined result, executing the first random determination again.

5 Claims, 13 Drawing Sheets

FIG.6

SYMBOL ARRAYS OF VIDEO REELS

| | REEL 1 | REEL 2 | REEL 3 | REEL 4 | REEL 5 |
|---|---|---|---|---|---|
| 0 | HEART | 9 | CHERRY | 9 | KING |
| 1 | CHERRY | JACK | KING | JACK | ACE |
| 2 | 7 | HEART | 9 | WILD | BELL |
| 3 | JACK | 7 | ACE | 9 | KING |
| 4 | KING | 10 | BELL | JACK | WATERMELON |
| 5 | WATERMELON | BONUS | 10 | HEART | WATERMELON |
| 6 | 10 | ACE | WATERMELON | KING | QUEEN |
| 7 | BELL | BELL | 10 | JACK | HEART |
| 8 | JACK | JACK | CHERRY | 10 | JACK |
| 9 | 9 | WATERMELON | 10 | BELL | 9 |
| 10 | BONUS | 9 | WATERMELON | 9 | CHERRY |
| 11 | JACK | CHERRY | JACK | BONUS | 10 |
| 12 | ACE | ACE | KING | ACE | 7 |
| 13 | BELL | QUEEN | HEART | 9 | ACE |
| 14 | KING | 9 | 7 | QUEEN | JACK |
| 15 | QUEEN | KING | 10 | 7 | 9 |
| 16 | HEART | WILD | 7 | CHERRY | KING |
| 17 | BONUS | ACE | BONUS | HEART | BONUS |
| 18 | 10 | QUEEN | 10 | ACE | ACE |
| 19 | 9 | WATERMELON | WILD | KING | BELL |
| 20 | 9 | 10 | QUEEN | WATERMELON | QUEEN |
| 21 | CHERRY | 9 | 10 | 10 | ACE |
| 22 | JACK | QUEEN | CHERRY | BELL | 9 |
| 23 | 10 | CHERRY | ACE | 9 | WATERMELON |
| 24 | WATERMELON | ACE | QUEEN | 10 | 10 |
| 25 | JACK | 9 | QUEEN | CHERRY | ACE |
| 26 | | 7 | BELL | KING | CHERRY |
| 27 | | BONUS | 9 | | QUEEN |
| 28 | | BELL | | | ACE |
| 29 | | | | | HEART |
| 30 | | | | | 10 |
| 31 | | | | | BELL |
| 32 | | | | | ACE |
| 33 | | | | | KING |
| 34 | | | | | |

FIG.7

SYMBOL COMBINATION TABLE

| SYMBOL | GRAPHICS | 1 | 2 | 3 | 4 | 5 |
|---|---|---|---|---|---|---|
| WILD | | 0 | 0 | 0 | 0 | 0 |
| 7 | | 0 | 0 | 50 | 300 | 1000 |
| HEART | | 0 | 0 | 35 | 200 | 800 |
| BELL | | 0 | 0 | 30 | 100 | 500 |
| WATERMELON | | 0 | 0 | 20 | 50 | 300 |
| CHERRY | | 0 | 0 | 15 | 35 | 300 |
| ACE | A | 0 | 0 | 10 | 30 | 200 |
| KING | K | 0 | 0 | 10 | 20 | 200 |
| QUEEN | Q | 0 | 0 | 10 | 15 | 100 |
| JACK | J | 0 | 0 | 10 | 15 | 100 |
| TEN | 10 | 0 | 0 | 5 | 15 | 100 |
| NINE | 9 | 0 | 0 | 5 | 10 | 100 |

| SYMBOL | GRAPHICS | 1 | 2 | 3 | 4 | 5 |
|---|---|---|---|---|---|---|
| BONUS | | 0 | 0 | FG10 | FG25 | FG50 |

※BONUS SYMBOL IS SCATTER TYPE

INFORMATION PROCESSOR

CROSS-REFERENCE TO RELATED APPLICATION

This application claims the benefit of Japanese Patent Application No. 2018-166661 filed on Sep. 6, 2018, which application is incorporated herein by reference in its entirety.

FIELD OF THE INVENTION

The present invention relates to an information processor.

BACKGROUND OF THE INVENTION

Typically, in a smartphone (information processor) in which game application software is installed, a social game, etc., random determinations are performed in response to a player's operation of a touch panel of a smartphone, and a game advances based on random determination results. In such a game, the game may shift to a different special game when a predetermined condition is satisfied in the advancement of the normal game. The predetermined condition is satisfied, for example, when an item which influences on the advancement of the game is exchanged with a monetary value deposited in the game through the purchase of a prepaid card, is exchanged with a monetary value obtained by paying money, or is obtained in random determination in the game (Patent Literature 1 (U.S. Pat. No. 9,272,213)).

When the shift to the special game occurs in the advancement of the game, the probability of obtaining a specific benefit or a payout by random determination may be (e.g., 1.5 times, 3 times or 5 times) higher than the probability of obtaining the specific benefit or payout by random determination in the normal game.

BRIEF SUMMARY OF THE INVENTION

An amount of owed monetary value is different between players. The game provider wishes to prompt many players to play the special game irrespective of the owned monetary value, but the probability of awarding a specific benefit must be changed according to the consumption amount of the monetary value, because the game provider is disadvantaged when the probability of awarding the specific benefit is uniform. It is therefore necessary to provide control corresponding to each consumption amount of the monetary value, but such an arrangement may be troublesome when a defect occurs or maintenance is performed.

Under this circumstance, the present invention provides an information processor in which the probability of awarding a specific benefit is controlled to be different depending on a consumption amount of monetary value but the occurrence of a defect and the need of maintenance can be easily handled.

The present disclosure relates to an information processor which executes a unit game in which a benefit is awarded based on a result of first random determination and includes: a storage unit configured to store conditions associated with different winning probabilities, respectively; a setting unit configured to set one of the conditions stored in the storage unit; and a controller which is programmed to execute the processes of: (a) setting a winning probability of second random determination based on the winning probability associated with the condition set by the setting unit; (b) determining whether to execute the first random determination by the second random determination based on the winning probability set in the process (a); (c) when a win is achieved in the second random determination in the process (b), executing the first random determination; and (d) when a result of the first random determination in the process (c) is different from a predetermined result, executing the first random determination again.

In the unit game in which the execution of the first random determination is selected in the second random determination, when a result of the first random determination is different from the predetermined result (e.g., winning of a bonus game), the first random determination is executed again to increase the probability of obtaining the predetermined benefit (winning of the bonus game). Meanwhile, the winning probability in the second random determination can be changed only by setting the condition by the setting unit. It is therefore unnecessary to modify the process itself, and the occurrence of a defect or the need of maintenance can be easily handled.

In an example of the present disclosure, the information processor is arranged such that the setting unit is able to set a multiplying factor including a fractional part, in accordance with each of the conditions, in the process (a), the winning probability of the second random determination is set based on a fractional part of a multiplying factor corresponding to the condition which is set by the setting unit, and in the process (d), the first random determination is repeatable the number of times corresponding to an integral part of the multiplying factor corresponding to the condition which is set by the setting unit.

When a multiplying factor (N.M timed) composed of an integral part N and a fractional part M is set in order to increase the probability of achieving the predetermined result in the first random determination, second random determination (for determining whether to execute the symbol random determination process once) is additionally executed with the winning probability (M/10) which is set based on the fractional part (M) of the multiplying factor. With this arrangement, it is possible to execute the first random determination with a multiplying factor less than one, while the same random determination as the first random determination corresponding to the integral part is utilized. To put it differently, first random determination with a multiplying factor having a fractional part is realized by a combination of two-staged random determinations, i.e., (i) repetition of the first random determination the number of times corresponding to an integral part of a multiplying factor having been set and (ii) execution of the first random determination which is executed when it is determined in second random determination (with the winning probability based on a fractional part of the multiplying factor having been set) to execute the first random determination.

The present disclosure relates to an information processor, which executes a unit game in which a benefit is awarded based on a result of first random determination and includes a controller which is programmed to execute the processes of: (a) setting a multiplying factor including a fractional part based on a predetermined condition; (b) repeating the first random determination the number of times corresponding to an integral part of the multiplying factor set in the process (a); (c) when a predetermined benefit is not awarded as a result of the first random determination in the process (b), executing second random determination for determining whether to execute the first random determination again, based on the fractional part of the multiplying factor set in the process (a); and (d) executing the first random determination when it is determined in the second random determination that the first random determination is executed.

The present disclosure relates to a method of controlling a unit game in which a benefit is awarded based on a result of first random determination, the method including the steps of: (a) setting a winning probability of second random determination based on a winning probability corresponding to a condition set by a setting unit which sets one of conditions associated with different winning probabilities, respectively; (b) determining whether to execute the first random determination by the second random determination based on the winning probability set in the step (a); (c) when a win is achieved in the second random determination in the step (b), executing the first random determination; and (d) when a result of the first random determination in the step (c) is different from a predetermined result, executing the first random determination again.

The present disclosure relates to a non-volatile recording medium storing a game program, the game program causing an information processor, which executes a unit game in which a benefit is awarded based on a result of first random determination, to execute the processes of: (a) setting a winning probability of second random determination based on a winning probability corresponding to a condition set by a setting unit which sets one of conditions associated with different winning probabilities, respectively; (b) determining whether to execute the first random determination by the second random determination based on the winning probability set in the process (a); (c) when a win is achieved in the second random determination in the process (b), executing the first random determination; and (d) when a result of the first random determination in the process (c) is different from a predetermined result, executing the first random determination again.

The present invention is able to provide an information processor in which the probability of awarding a specific benefit is controlled to be different depending on a consumption amount of monetary value but the occurrence of a defect and the need of maintenance can be easily handled.

BRIEF DESCRIPTION OF THE DRAWINGS

FIG. 6 illustrates symbol arrays of video reels in the slot game.

FIG. 7 illustrates a symbol combination table of the slot game.

DETAILED DESCRIPTION OF THE PREFERRED EMBODIMENT

Embodiment

An information processor of the present embodiment will be described with reference to figures.

A game executed in the present embodiment is installed in and executed by an information processor, as application software (program and game data). Examples of the information processor include mobile information devices such as a smartphone, a portable computer, a laptop computer, a note PC, a tablet PC, a handheld PC, and a PDA (Personal Data Assistant). The application software by which the game is executed is downloaded from a server or the like via communication means (see FIG. 2) and stored in a storage device (e.g., a flash memory 104) in the information processor. The communication means may be an interactive communication passage such as the Internet and a cable TV, or may be one-way broadcasting.

The application software by which the game is executed may be stored in a recording medium such as a CD-ROM, a DVD-ROM, an MO (optical magnetic disc), and a flash memory, and may be read from the recording medium and installed in a storage device of the information processor, according to need.

Figure 1:
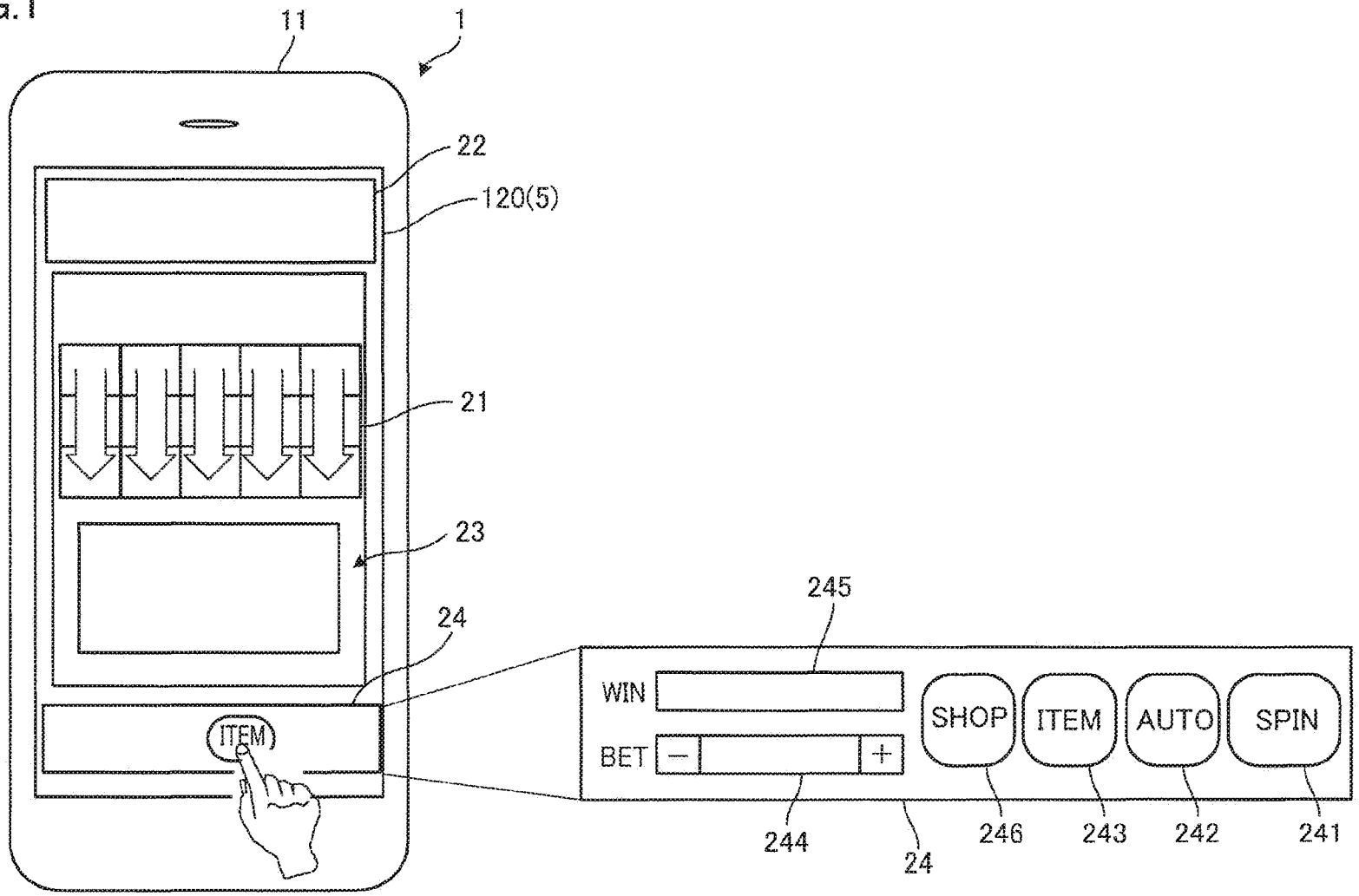
FIG. 1 illustrates a display state of a smartphone (information processor).

In the present embodiment, a smartphone 1 shown in FIG. 1 is taken as an example of the information processor. While the descriptions below deal with the smartphone 1, processes and operations of the smartphone 1 can be interpreted as those of a program or a game control method.

The game may be embodied as a social game. To be more specific, the application software of the game may be executed on a web browser provided by a server, and the game may be run in such a way that a mobile information device such as a smartphone accesses to the web browser provided by the server. In this case, the server, or a combination of the server and the mobile information device such as a smartphone which accesses to the server is equivalent to the information processor of the present invention.

(Online)

Figure 2:
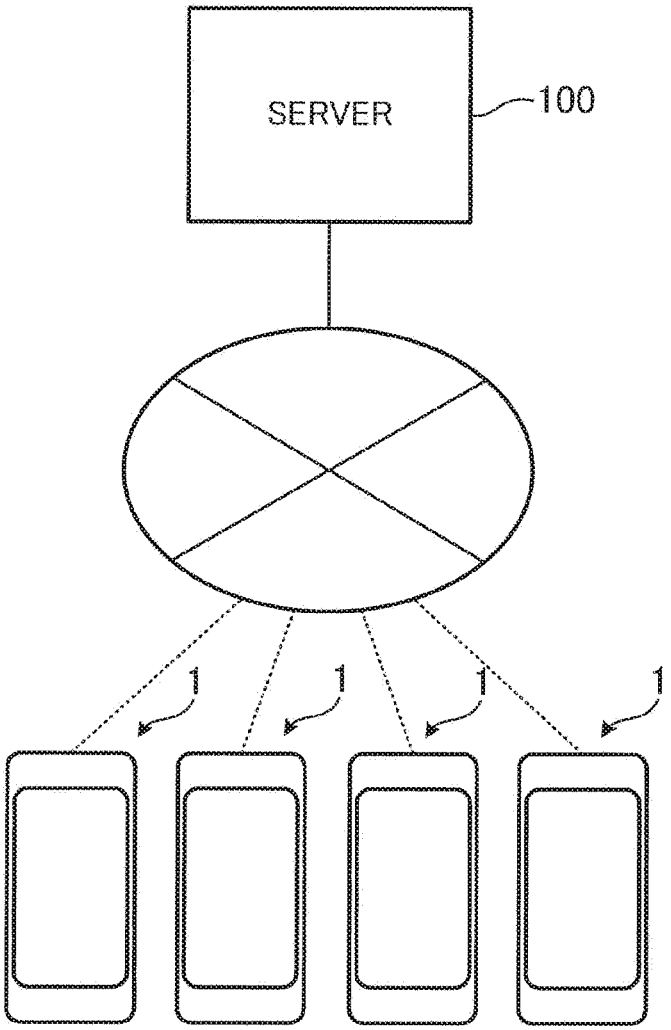
FIG. 2 shows a network environment between the smartphone and a server.

The game of the present embodiment is a slot game and is run as an online game. To be more specific, as shown in FIG. 2, the server 100 managed by an administration organization of the slot game is connected to smartphones 1 of many players over a computer network (Internet).

In this way, the slot game is run online. A player is able to download the application software of the slot game from the server 100, install it in the smartphone 1, and run the slot game. The server 100 (management system) is configured to exchange credits (which can be bought by cash, a credit card, electronic money, a prepaid card, etc.) owned by players to coins (gaming media) which are electronic information usable in the slot game, and to manage the coins owned by the players.

(Structure of Smartphone 1)

Figure 3:
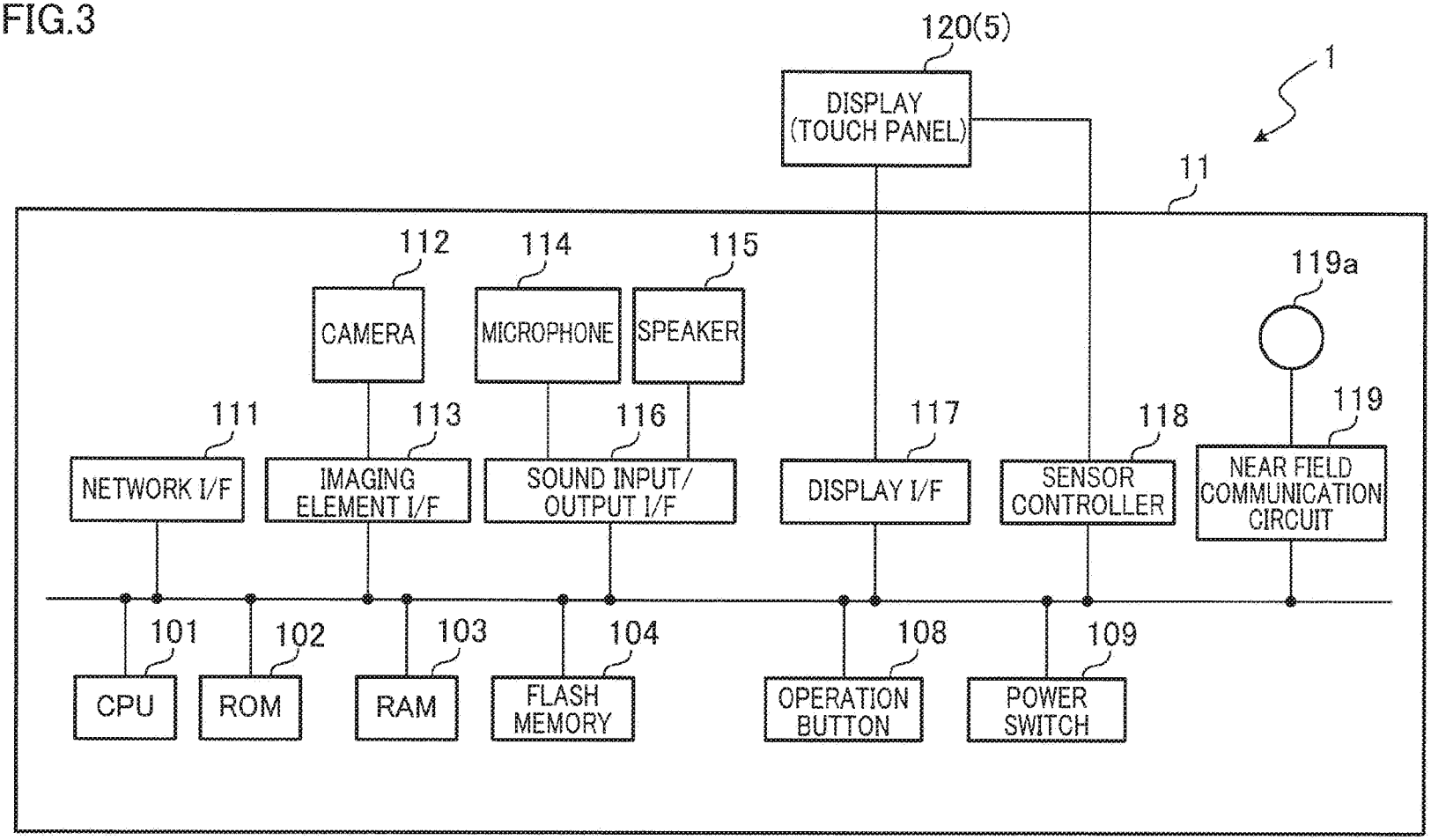
FIG. 3 is a block diagram of the electrical configuration of the smartphone (information processor).

As shown in FIG. 3, the smartphone 1 includes, in a housing 11, a CPU 101 (controller), a ROM 102, a RAM 103, a flash memory 104, an operation button 108, a power switch 109, a bus line 110, a network I/F 111, a camera 112, an imaging element I/F 113, a microphone 114, a speaker 115, a sound input/output I/F 116, a display I/F 117, a sensor controller 118, a near field communication circuit 119, and an antenna 119*a* of the near field communication circuit 119. In the front surface of the housing 11, a display 120 with a touch panel 5 (input unit) is embedded.

The display 120 is configured to be able to display images. The display method of the display 120 is, for example, liquid crystal, organic electroluminescence, CRT (Cathode Ray Tube), or plasma.

The CPU (Central Processing Unit) 101 controls the entire smartphone 1. The ROM (Read Only Memory) 102 stores programs used for driving the CPU 101, such as an IPL (Initial Program Loader).

The RAM (Random Access Memory) 103 is used as a work area of the CPU 101. The flash memory 104 stores application software (program) for running the game of the present embodiment, a communication program, and data such as image data and sound data (e.g., symbol arrays of later-described video reels, game data required by a symbol combination table and the slot game, and the number of owned coins). The operation button 108 is used for, for example, initial setting of the smartphone 1. The power switch 109 is used for turning on/off the power source of the smartphone 1.

The network I/F (Interface) 111 is an interface for performing data communication with the server 100, etc., by utilizing a communication network such as the Internet. The camera 112 is a built-in camera image capturing means which captures an image of an object to obtain image data under the control of the CPU 101. The imaging element I/F 113 is a circuit for controlling the camera 112. The microphone 114 is a built-in sound collection means to which sound is input. The sound input/output I/F 116 is a circuit for processing input and output of a sound signal between the microphone 114 and the speaker 115 under the control of the CPU 101. The display I/F 117 is a circuit for sending image data to the display 120 under the control of the CPU 101. The sensor controller 118 is a circuit for receiving an input from the touch panel 5 of the display 120. The near field communication circuit 119 is a communication circuit based on NFC (Near Field Communication) (Registered Trademark). Bluetooth (Registered Trademark), or the like. The bus line 110 is an address bus, a data bus, or the like for electrically connecting the components such as the CPU 101.

(Outline of Slot Game Executed by Smartphone 1)

In the smartphone 1 arranged as described above, the CPU 101 executes the application software of the slot game based on the program.

When the application software of the slot game is executed in the smartphone 1, images such as game start effect images are displayed. Thereafter, the slot game starts upon selection of a selection image indicating the start of the slot game on the touch panel 5 (detailed later). For example, as shown in FIG. 1, when the slot game starts, the slot game in which symbols are rearranged in a symbol display area 21 which is formed of 15 areas forming a matrix with 5 columns and 3 rows is executed (details will be given later).

There may be plural selectable slot games, and the rule, the state of payout, and effect images may be different depending on which slot game is executed. For example, in a slot game of one type, symbols are rearranged in a symbol display area formed of 9 areas forming a matrix with 3 columns and 3 rows. In this slot game, whether a win is achieved is determined based on a combination of symbols rearranged on a payline set only at the middle stage of the symbol display area (winning determination).

The slot game of the present embodiment is basically started in response to the consumption of a predetermined amount of coins (gaming media) owned by a player. When a predetermined condition is satisfied, the player is able to start the slot game without the consumption of coins. (The predetermined condition is, for example, a condition of awarding a free game or the slot game is playable without the consumption of coins for a predetermined number of times in a day.)

The coins (gaming media) owned by players are electronic information. A player accesses the server 100 via the smartphone 1 and exchanges credits to coins in accordance with a payment method specified by the management organization of the slot game. The coins owned by players are used in various ways. For example, the coins are consumed to obtain an effect influencing on the slot game (as purchase of items), or consumed to change the appearance of an avatar of a player.

The number of coins owned by each player, which is managed by the server 100, is shared between the server 100 and each smartphone 1 by communication. The flash memory 104 of the smartphone 1 stores the number of coins owned by the player, which is shared with the server 100.

The gaming medium is not limited. For example, when the slot game of the present embodiment is run on a gaming machine (slot machine) installed in a hall or the like, the gaming medium may be a medal, a token, electronic money, a ticket, etc. The ticket is not particularly limited, and a barcoded ticket may be adopted for example. Alternatively, the gaming medium may be a game point not including valuable information.

(Slot Game: Definitions)

The slot game executed in the present embodiment is a game in which symbols are varied in the symbol display area 21 (scrolling image of reels) and then stopped (rearranged), and a benefit (e.g., a payout or an item advantageous or disadvantageous for the player) is awarded based on the combination of the symbols displayed in the symbol display area 21. A state in which symbols are displayed after being varied and stopped in the symbol display area 21 is termed "rearrangement".

A payout awarded based on a combination of symbols displayed in the symbol display area 21 is awarding of coins.

The "unit game" is a series of operations from the start of the receiving of a bet to the establishment of a prize (i.e., a combination of symbols satisfies a predetermined relation). To put it differently, the unit game includes a single bet time for receiving a bet, a single game time of rearranging stopped symbols, and a single payout time of a payout process of awarding a payout.

(Slot Game Screen)

A slot game screen displayed on the display 120 of the smartphone 1 will be described.

As shown in FIG. 1, when the slot game is executed, the slot game screen is displayed on the display 120. The slot game screen displays the symbol display area 21 formed of 15 areas forming a matrix with 5 columns and 3 rows, a game information display area 22 on which information of increment and decrement in accordance with the execution of the slot game (e.g., the number of currently-owned coins) is displayed, an effect display area 23 on which moving and still images and messages related to the game are displayed in accordance with the progress of the slot game, and an operation display area 24 which is operated by the player to progress the slot game. The operation display area 24 includes a spin button 241, an AUTO button 242, an ITEM button 243, a bet button 244, a WIN display portion 245, and a shop button 246.

On the entire surface of the display 120, a touch panel 5 which allows the slot game screen to be viewable from the outside is provided. The touch panel 5 makes it possible to detect the coordinates of a part touched by a player's finger or the like. With this arrangement, for example, the slot game (unit game) is executed once, upon a touch input of the image of the spin button 241. Furthermore, the slot game is serially executed plural times as the image of the AUTO button 242 is pressed. When the image of the ITEM button 243 is pressed, the player is able to select and use a previously-obtained item (which exerts an influence in the slot game). When the image of the shop button 246 is touched, the smartphone 1 accesses the server 100 and the player enters a shop in which credits (which can be bought by cash, a credit card, electronic money, a prepaid card, etc. owned by the player) are exchangeable with coins, or credits or coins are exchangeable with an item.

(Symbol Display Area 21)

Figure 4:
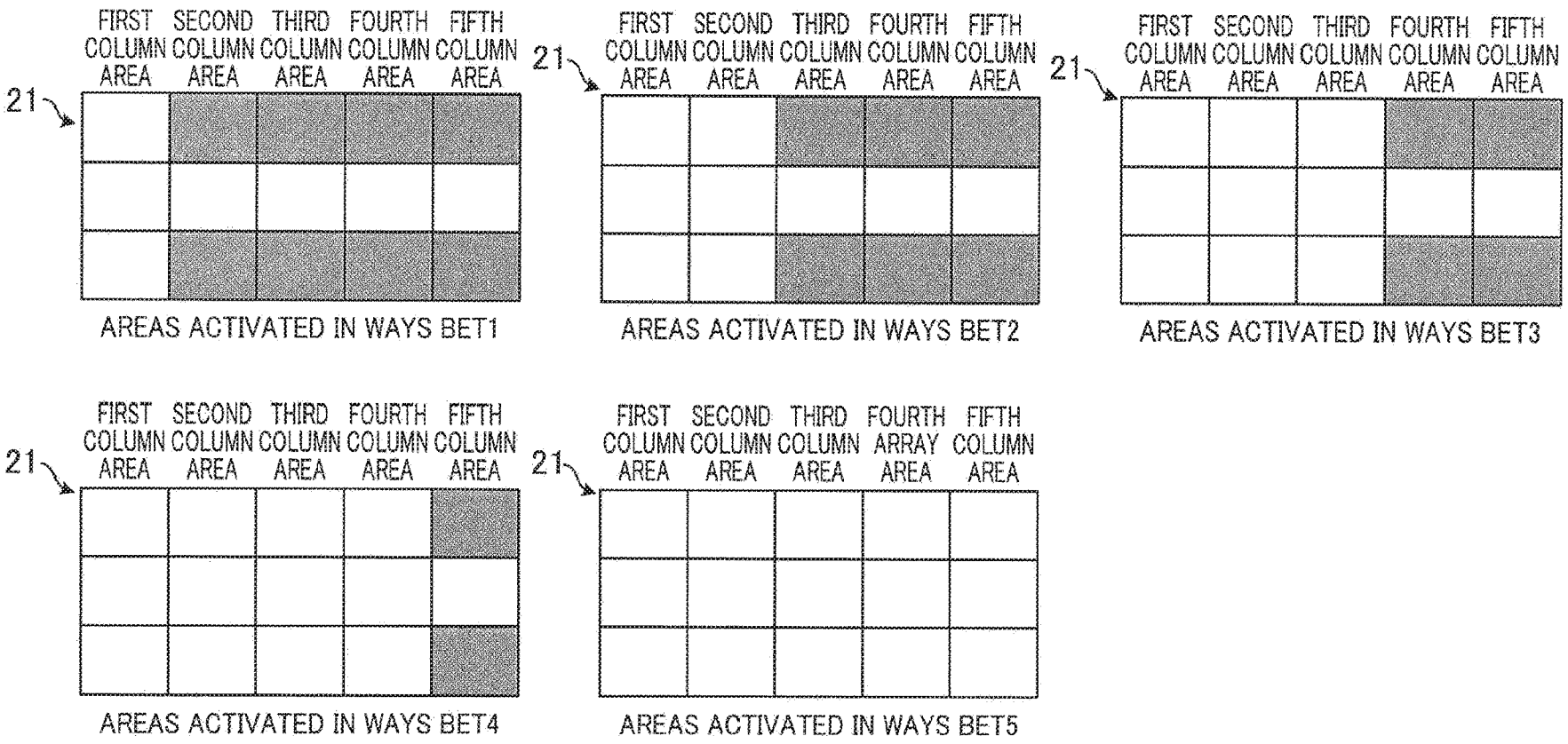
FIG. 4 illustrates active areas of "WAYS BET" in a slot game.
Figure 5:
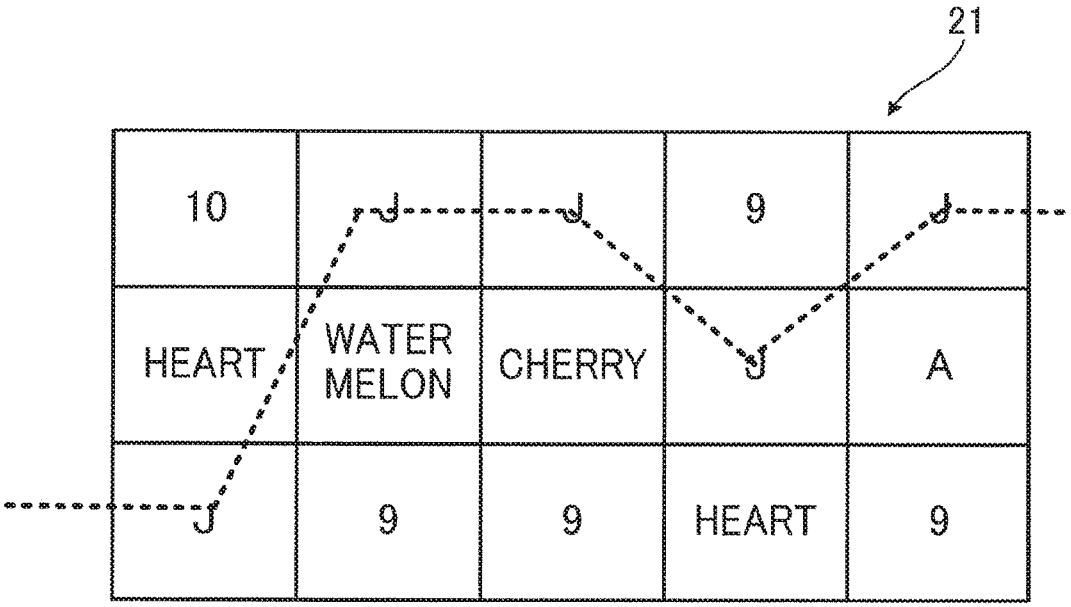
FIG. 5 illustrates an example of result determination of "WAYS BET" in the slot game.

The symbol display area 21 of the slot game includes five column areas (first column area to fifth column area) each of which is divided into three areas: the upper stage, the middle stage, and the lower stage, as shown in FIG. 4 and FIG. 5. In the first column area to the fifth column area, five video reels 3 (REEL1, REEL2, REEL3, REEL4, and REEL5) are displayed, respectively. On the video reels 3 of the slot game of the present embodiment, the rotation and stop of mechanical reels having circumferential surfaces on which symbols are depicted are expressed by video. To each of the video reels 3 (REEL1, REEL2, REEL3, REEL4, and REEL5), a symbol array each constituted by plural symbols is allocated (see FIG. 6).

In the symbol display area 21, the symbol array allocated to each of the video reels 3 (REEL1, REEL2, REEL3, REEL4, and REEL5) scrolls and stops after elapse of a predetermined time. As a result, parts of each symbol array (three successive symbols) are displayed in the symbol display area 21 one by one. In each of the first column area to the fifth column area of the symbol display area 21, one symbol is displayed in each of the three areas, i.e., the upper stage, the middle stage, and the lower stage, according to the corresponding video reel 3 (REEL1, REEL2, REEL3, REEL4, and REEL5). To put it differently, 15 symbols forming a 5 by 3 matrix are displayed in the symbol display area 21.

As described above, in the symbol display area 21, 15 areas are provided to form a matrix in such a way that five column areas (columns) and three stages (stages) which are the upper stage, the middle stage, and the lower stage intersect with one another.

In the slot game, "LEFT TO RIGHT" type is adopted for determining a win. That is, to begin with, by selecting one of five stages of WAYS BET (WAYS BET1, WAYS BET2, WAYS BET3, WAYS BET4, and WAYS BET5), areas to be subjected to result determination are selected out of 15 areas (the 5 by 3 matrix) of the symbol display area 21 (determination of active areas) (see FIG. 4). Then a win occurs when a predetermined number of symbols stopped in the result determination areas of the first column area to the fifth column area, which areas are subjected to result determination, are linked (see FIG. 5).

The selection of the five stages of WAYS BET (WAYS BET1, WAYS BET2, WAYS BET3, WAYS BET4, and WAYS BET5) is done by a touch input to the "+" or "−" button (see FIG. 1) of the bet button 244 (equivalent to a betting device). 2 coins are required to select the WAYS BET1. 3 coins are required to select the WAYS BET2. 7 coins are required to select the WAYS BET3. 15 coins are required to select the WAYS BET4. 25 coins are required to select the WAYS BET5.

Specifically, as shown in FIG. 4, when "WAYS BET1" is selected, the areas out of the symbol display area 21 subjected to result determination (areas activated) are: the upper stage, the middle stage, and the lower stage of the first column area; the middle stage of the second column area; the middle stage of the third column area; the middle stage of the fourth column area; and the middle stage of the fifth column area. Further, when "WAYS BET2" is selected, the areas out of the symbol display area 21 subjected to result determination (areas activated) are: the upper stage, the middle stage, and the lower stage of the first column area; the upper stage, the middle stage, and the lower stage of the second column area; the middle stage of the third column area; the middle stage of the fourth column area; and the middle stage of the fifth column area. Further, when "WAYS BET3" is selected, the areas out of the symbol display area 21 subjected to result determination (areas activated) are: the upper stage, the middle stage, and the lower stage of the first column area; the upper stage, the middle stage, and the lower stage of the second column area; the upper stage, the middle stage, and the lower stage of the third column area; the middle stage of the fourth column area; and the middle stage of the fifth column area. Further, when "WAYS BET4" is selected, the areas out of the symbol display area 21 subjected to result determination (areas activated) are: the upper stage, the middle stage, and the lower stage of the first column area; the upper stage, the middle stage, and the lower stage of the second column area; the upper stage, the middle stage, and the lower stage of the third column area; the upper stage, the middle stage, and the lower stage of the fourth column area; and the middle stage of the fifth column area. Further, when "WAYS BET5" is selected, the areas out of the symbol display area 21 subjected to result determination (areas activated) are: the upper stage, the middle stage, and the lower stage of the first column area; the upper stage, the middle stage, and the lower stage of the second column area; the upper stage, the middle stage, and the lower stage of the third column area; the upper stage, the middle stage, and the lower stage of the fourth column area; and the upper stage, the middle stage, and the lower stage of the fifth column area.

For example, as shown in FIG. 5, when the "WAYS BET5" is selected, all the areas out of the symbol display area 21 are subjected to result determination (activated). As shown in FIG. 5, when "J: Jack" symbols stop in the lower stage of the first column area, the upper stage of the second column area, the upper stage of the third column area, the middle stage of the fourth column area, and the upper stage of the fifth column area, there is a single win in which the five symbols are successively linked from the first column area to the fifth column area (LEFT TO RIGHT). As such, in the "LEFT TO RIGHT" type, the symbols may appear to be scattered at the first sight; however, if they are successively linked throughout the first column area to the fifth column area, it is determined as a win. Although the slot game of the present embodiment adopts the "LEFT TO RIGHT" type, it is possible to adopt a line type which regards as a winning line only a line connecting the middle stages of the column areas of the respective arrays. Alternatively, the slot game may adopt a scatter type in which whether a win is achieved is determined based on the number of symbols of the same type displayed in the symbol display area 21.

(Symbol Arrays of Video Reels)

Now, with reference to FIG. 6, the following describes a configuration of the symbol arrays on the video reels 3 of the slot game.

As shown in FIG. 6, to each of "REEL1", "REEL2", "REEL3", "REEL4", and "REEL5" of the video reels 3, a symbol array formed of symbols corresponding to code numbers 0 to 33 is allocated. The types of the symbols arranged on the symbol arrays of the video reels 3 include normal symbols such as "7", "HEART", "BELL", "WATERMELON", "CHERRY", "ACE(A)", "KING(K)", "QUEEN(Q)", "JACK(J)", "10", and "9", a "WILD" symbol which is an almighty symbol that can substitute for any other symbol, and a "BONUS" symbol with which BONUS triggering the awarding of a free game is won.

(Symbol Combination Table)

Now, a symbol combination table will be described with reference to FIG. 7. FIG. 7 shows a symbol combination table used in the slot game of the present embodiment.

The symbol combination table of the slot game defines the combinations of symbols (the number of symbols) with which a win is achieved and payout amounts of coins paid out (payout). In the slot game, a win is achieved when the scroll of the symbol arrays of the video reels 3 is stopped and a predetermined number of symbols of a predetermined type are linked in the areas in the symbol display area 21, which are subjects of result determination in the WAYS BET described above, from the first column area to the fifth column area. In accordance with the type of win, a benefit will be given to the player in the form of awarding a payout and the like.

Basically, a win is achieved when a predetermined number of symbols of a single type are arranged and linked to one another, as in three-symbols (3Kind), four-symbols (4Kind), or five-symbols (5Kind) combination, through the first column area to the fifth column area, within the winning determination areas set as the subject to winning determination, by the WAYS BET described above. The above symbols of the single type are "7", "HEART", "BELL", "WATERMELON", "CHERRY", "A", "K", "Q", "J", "10", and "9". It should be noted that, for the "WILD" symbol, any of the following types of symbols is substituted: "7", "HEART", "BELL", "WATERMELON", "CHERRY", "A", "K", "Q", "J", "10", and "9".

The "BONUS" symbol is a scatter symbol, and whether a win is achieved is determined by the number of symbols stopped in 15 areas forming the matrix of 5 columns and 3 rows in the symbol display area 21.

For example, when "WAYS BET3" is selected, the areas out of the symbol display area 21 subjected to result determination (areas activated) are: the upper stage, the middle stage, and the lower stage of the first column area; the upper stage, the middle stage, and the lower stage of the second column area; the upper stage, the middle stage, and the lower stage of the third column area; the middle stage of the fourth column area; and the middle stage of the fifth column area. When the scroll of the symbol arrays on the video reels 3 (REEL1, REEL2, REEL3, REEL4, and REEL5) is stopped and the "7" symbol occurs in the lower stage of the first column area, the upper stage of the second column area, and the middle stage of the third column area, there is a win in which the "7" symbol occurs in three linked positions from the first column area to the third column area (3Kind combination of "7" is formed). In this case, the symbol combination table shown in FIG. 7 is referred to, and the payout amount of coins is determined as "50". Based on the determined payout amount of coins, a payout is awarded.

In the slot game, a bet amount required for one selection of each of five-staged WAYS BET is set as follows: 2 coins for WAYS BET1, 3 coins for WAYS BET2, 7 coins for WAYS BET3, 15 coins for WAYS BET4, and 25 coins for WAYS BET5.

WAYS BET may be selected plural times in a unit game. For example, when WAYS BET3 (7 coins) is selected three times, the total bet amount is 21 coins (7×3=21). When 3Kind of "7" is achieved, the payout amount of coins is 150 coins (50×3=150).

[Contents of Program] The program of the slot game executed by the smartphone 1 will be described with reference to FIG. 8 to FIG. 10.

(Normal Slot Game Control Process)

Figure 8:
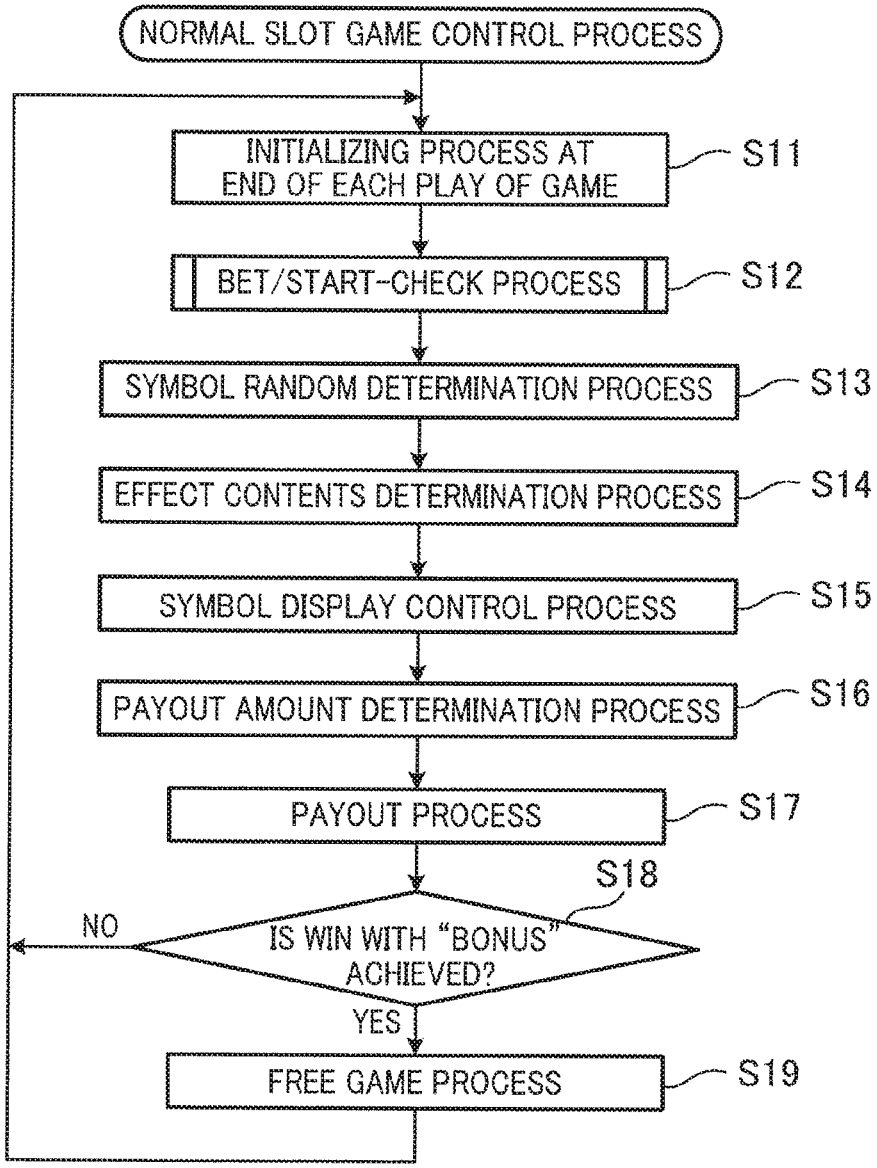
FIG. 8 shows a flowchart of a normal slot game control process.
Figure 9:
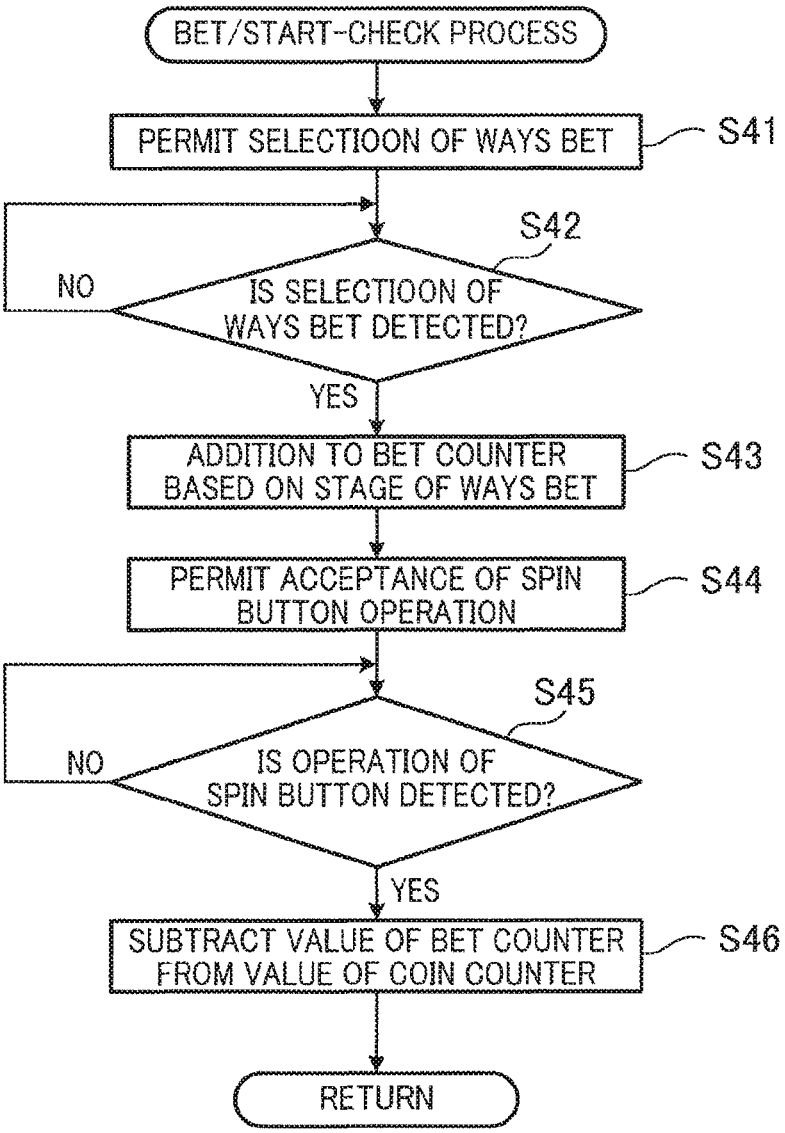
FIG. 9 shows a flowchart of a bet/start-check process.

Referring to FIG. 8, a normal slot game control process will be described. When the slot game starts in the application software, the normal slot game control process is executed if no item is used.

To begin with, the CPU 101 executes an initializing process at the end of each play of the game, in order to start the slot game (S11). For example, this process clears data in a working area of the flash memory 104, which becomes unnecessary at the end of each play of the unit game, e.g., WAYS BET activated in the previous execution of the unit game and symbols to be displayed on the symbol display area 21 as a result of random determination.

The CPU 101 then executes a later-described bet/start-check process (S12). In this process, the CPU 101 checks an input such as WAYS BET (WAYS BET1, WAYS BET2, WAYS BET3, WAYS BET4, or WAYS BET5) selected by using the touch panel 5, etc. At this stage, as shown in FIG. 4, an area which is selected as a subject of result determination in the symbol display area 21 on account of the selection of WAYS BET is shown in white, in order to differentiate such an area from areas (shown in black) which are not subjects of result determination. This makes it possible to visually discern an area which is a subject of result determination from an area which is not a subject of result determination.

Subsequently, the CPU 101 executes a symbol random determination process (S13). In this symbol random determination process, by using the symbol arrays of the video reels 3 shown in FIG. 6, to-be-stopped symbols are randomly selected from symbols provided on the symbol arrays (REEL1, REEL2, REEL3, REEL4, and REEL5) of the video reels. The to-be-stopped symbols are data of 5 symbols displayed in the middle stages of the first column area to the fifth column area of the symbol display area 21, among the symbols constituting the symbol arrays of the video reels 3. In this way, 15 symbols displayed in the symbol display area 21 are determined.

For example, in case of REEL1 of the video reels 3, when a code number "21" is randomly selected from 26 symbols (code numbers "0" to "25") constituting the symbol array, the "CHERRY" symbol corresponding to the code number "21" is selected as the to-be-stopped symbol. In case of the REEL2, when a code number "10" is randomly selected from 29 symbols (code numbers "0" to "28") constituting the symbol array, the "9" symbol corresponding to the code number "10" is selected as the to-be-stopped symbol. In case of the REEL3, when a code number "8" is randomly selected from 28 symbols (code numbers "0" to "27") constituting the symbol array, the "CHERRY" symbol corresponding to the code number "8" is selected as the to-be-stopped symbol. In case of the REEL4, when a code number "7" is randomly selected from 27 symbols (code numbers "0" to "26") constituting the symbol array, the "J" symbol corresponding to the code number "7" is selected as the to-be-stopped symbol. In case of the REEL5, when a code number "6" is randomly selected from 34 symbols (code numbers "0" to "33") constituting the symbol array, the "Q" symbol corresponding to the code number "6" is selected as the to-be-stopped symbol.

The CPU 101 then stores the determined five to-be-stopped symbols in a symbol storing area in the flash memory 104.

Subsequently, the CPU 101 executes an effect contents determination process (S14). The CPU 101 samples an effect-use random number and randomly selects any of a plurality of predetermined effect contents.

Then, the CPU 101 executes a symbol display control process (S15). In this symbol display control process, the scroll of the symbol arrays of the video reels 3 starts. After a predetermined time elapses, the five to-be-stopped symbols selected in the symbol random determination process in S14 stop one by one in the middle stages of the first column area to the fifth column area of the symbol display area 21. In other words, 15 symbols including the to-be-stopped symbols are rearranged in the symbol display area 21. For example, as described above, when the "CHERRY" symbol is selected as a to-be-stopped symbol in the REEL1, the "9" symbol is selected as a to-be-stopped symbol in the REEL2, the "CHERRY" symbol is selected as a to-be-stopped symbol in the REEL3, the "J" symbol is selected as a to-be-stopped symbol in the REEL4, and the "Q" symbol is selected as a to-be-stopped symbol in the REEL5, the symbols "CHERRY", "9", "CHERRY", "J", and "Q" are provided in the middle stages of the first column area to the fifth column area of the symbol display area 21. In each of the upper stages and the lower stages of the first column area to the fifth column area of the symbol display area 21, a symbol having code number which is one number ahead of or behind the to-be-stopped symbol is rearranged (see FIG. 13).

Subsequently, the CPU 101 executes a payout amount determination process (S16). In this process, based on the symbol combination table (see FIG. 7) of the slot game stored in the flash memory 104, whether a win is achieved is determined based on whether the symbols rearranged in the symbol display area 21 form a predetermined number of linked symbols from the first column area to the fifth column area in the areas which are selected as subjects of result determination in the WAYS BET above. In accordance with the type of win, a benefit will be given in the form of awarding a payout and the like. The payout awarded is stored in a payout amount storage area of the flash memory 104.

Figure 13:
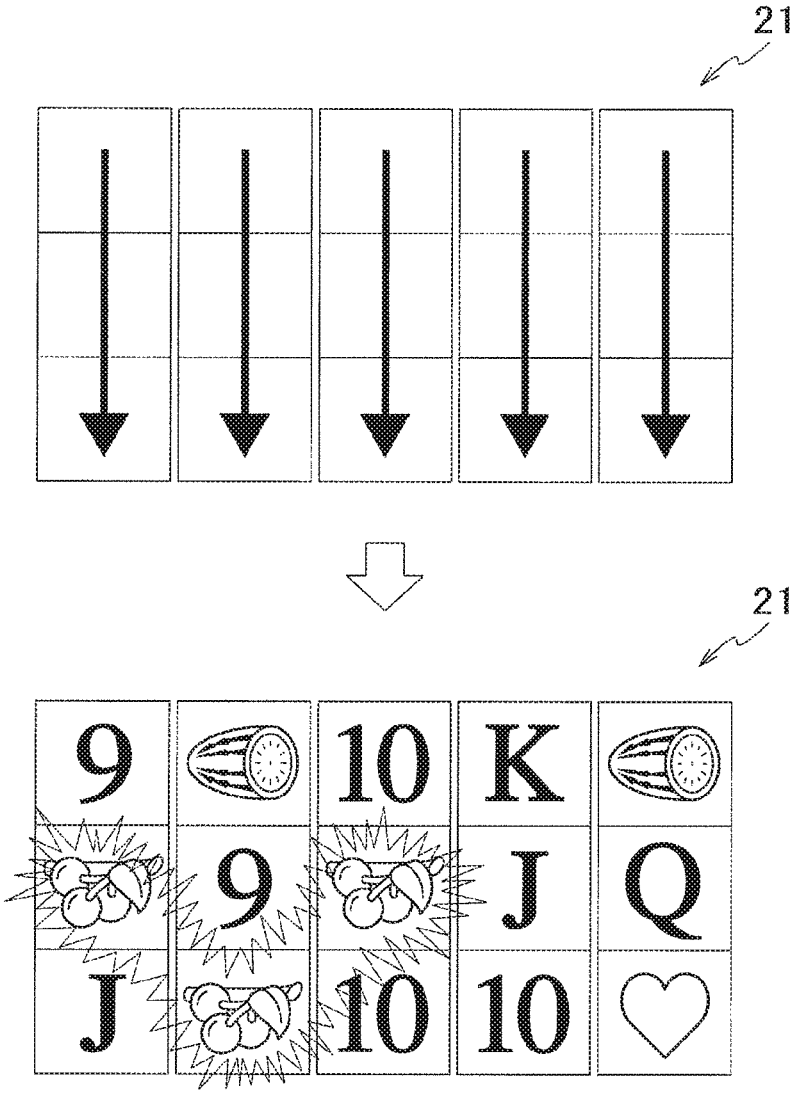
FIG. 13 illustrates the slot game displayed on the display.

For example, when "WAYS BET3" is selected, the areas out of the symbol display area 21 subjected to result determination (areas activated) are: the upper stage, the middle stage, and the lower stage of the first column area; the upper stage, the middle stage, and the lower stage of the second column area; the upper stage, the middle stage, and the lower stage of the third column area; the middle stage of the fourth column area; and the middle stage of the fifth column area. As shown in FIG. 13, when "CHERRY" symbols stop in the middle stage of the first column area, the lower stage of the second column area, and the middle stage of the third column area, there is a single win in which the three symbols are successively linked from the first column area to the third column area (LEFT TO RIGHT). In order to visually show the establishment of 3Kind of "CHERRY", the three "CHERRY" symbols emit light and then flicker, as shown in FIG. 13. For the 3Kind of "CHERRY", the symbol combination table shown in FIG. 7 is referred to, and a payout is determined as "15" coins and this payout amount is stored in the payout amount storage area in the flash memory 104.

Subsequently, the CPU 101 executes a payout process (S17). The CPU 101 adds a value stored in the payout amount storage area to the value of a coin counter provided in the flash memory 104. For example, when "15" is stored in the payout amount storage area in the payout amount determination process in S16, "15" is added to the value of the coin counter.

Subsequently, the CPU 101 determines whether a win of "BONUS" (3Kinds of "BONUS", 4Kind of "BONUS", or 5Kind of "BONUS") is achieved (S18). When the "BONUS" win is achieved (YES in S18), the CPU 101 executes a free game process (S19). This free game process allows the player to play the slot game without the consumption of coins, the number of times corresponding to the Kinds of the BONUS (10 times in 3Kinds of BONUS, 25 times in 4Kinds of BONUS, and 50 times in 5Kinds of BONUS).

If the "BONUS" win is not achieved (NO in S18) or after S19, the routine proceeds to S11.

(Bet/Start-Check Process)

Now, the bet/start-check process will be described with reference to FIG. 9.

To begin with, the CPU 101 permits acceptance of selection of 5-staged WAYS BET (WAYS BET1, WAYS BET2, WAYS BET3, WAYS BET4, and WAYS BET5) by the pressing of the "+" or "−" button (see FIG. 1) of the bet button 244 of the operation display area 24 through the touch panel 5 (S41). As a result of selection of any of the five stages of WAYS BET, an area to be subjected to result determination is selected out of 15 areas of the 5 by 3 matrix of the symbol display area 21 (see FIG. 4).

Subsequently, the CPU 101 determines whether a selection operation (pressing) of the 5-staged WAYS BET (WAYS BET1, WAYS BET2, WAYS BET3, WAYS BET4, and WAYS BET5) is detected (S42). When a selection operation of the WAYS BET is not detected (NO in S42), a selection operation is waited for.

Meanwhile, when a selection operation of WAYS BET (WAYS BET1, WAYS BET2, WAYS BET3, WAYS BET4, and WAYS BET5) is detected (YES in S42), the CPU 101 adds, to the value of the bet counter in the flash memory 104, coins necessary for the WAYS BET (2 coins in case of WAYS BET1, 3 coins in case of WAYS BET2, 7 coins in case of WAYS BET3, 15 coins in case of WAYS BET4, or 25 coins in case of WAYS BET5) (S43).

Subsequently, after S43, the CPU 101 allows the spin button 241 to accept an operation (S44).

After S44, the CPU 101 determines whether or not an operation of the spin button 241 is detected (S45). When the CPU 101 determines that an operation of the spin button 241 is not detected (NO in S45), an operation of the spin button 241 is waited for.

Meanwhile, when the CPU 101 determines that an operation of the spin button 241 is detected (YES in S45), the CPU 101 subtracts the value of the bet counter calculated in S43 from the value of the coin counter (S46). Then the bet/start check process is terminated.

(Improved Winning Probability Slot Game Control Process)

An improved winning probability slot game control process will be described with reference to FIG. 10. When the slot game starts in the application software, the improved winning probability slot game control process is executed if a predetermined item is used. For example, in the present embodiment, an item "BONUS Winning Probability 1.5 Timed 100 Rotations" is used.

Figure 11:
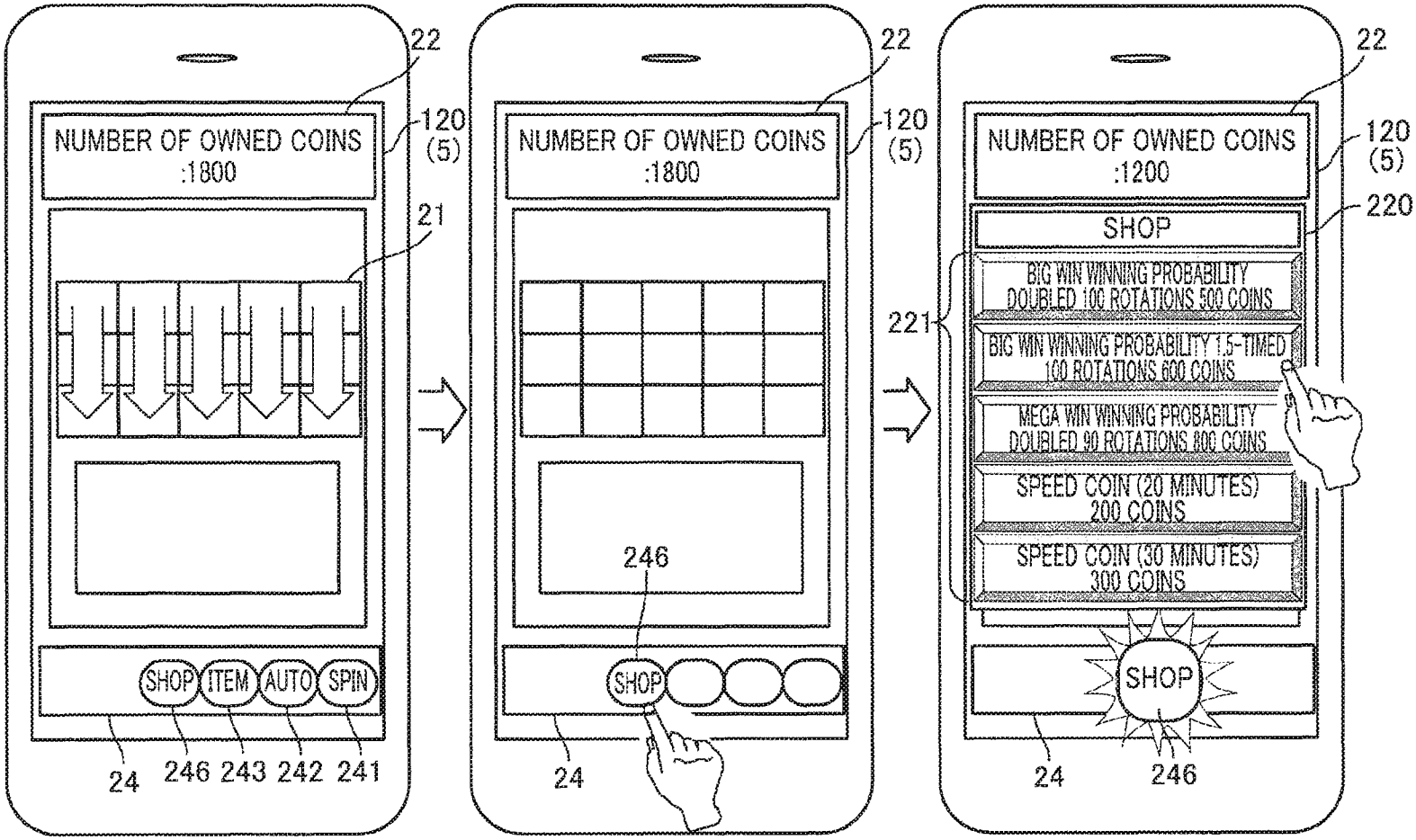
FIG. 11 illustrates a shop screen displayed on a display.

Before describing the improved winning probability slot game control process, how an item is obtained in the slot game of the present embodiment will be briefly described. In the slot game of the present embodiment, various items can be obtained in the advancement of the slot game, as a benefit awarded as a result of the slot game, or in exchange for coins in a shop. For example, as shown in FIG. 11, after the end of the unit game in the slot game, etc., the player is allowed to touch an image of a shop button 246 in the operation display area 24 to display a shop window 220 in which exchange to various items can be done. In the shop window 220, as shown in FIG. 11, icons 221 each associated with the number of coins required to exchange for an item are displayed. The player is allowed to select any of the displayed icons 221 to exchange the owned coins for a desired item. For example, as shown in FIG. 11, when the icon 221 corresponding to the item "BONUS Winning Probability 1.5 Timed 100 Rotations" is selected from the icons 221, 600 coins are subtracted from the owned coins and the item "BONUS Winning Probability 1.5 Timed 100 Rotations" is obtained.

Figure 12:
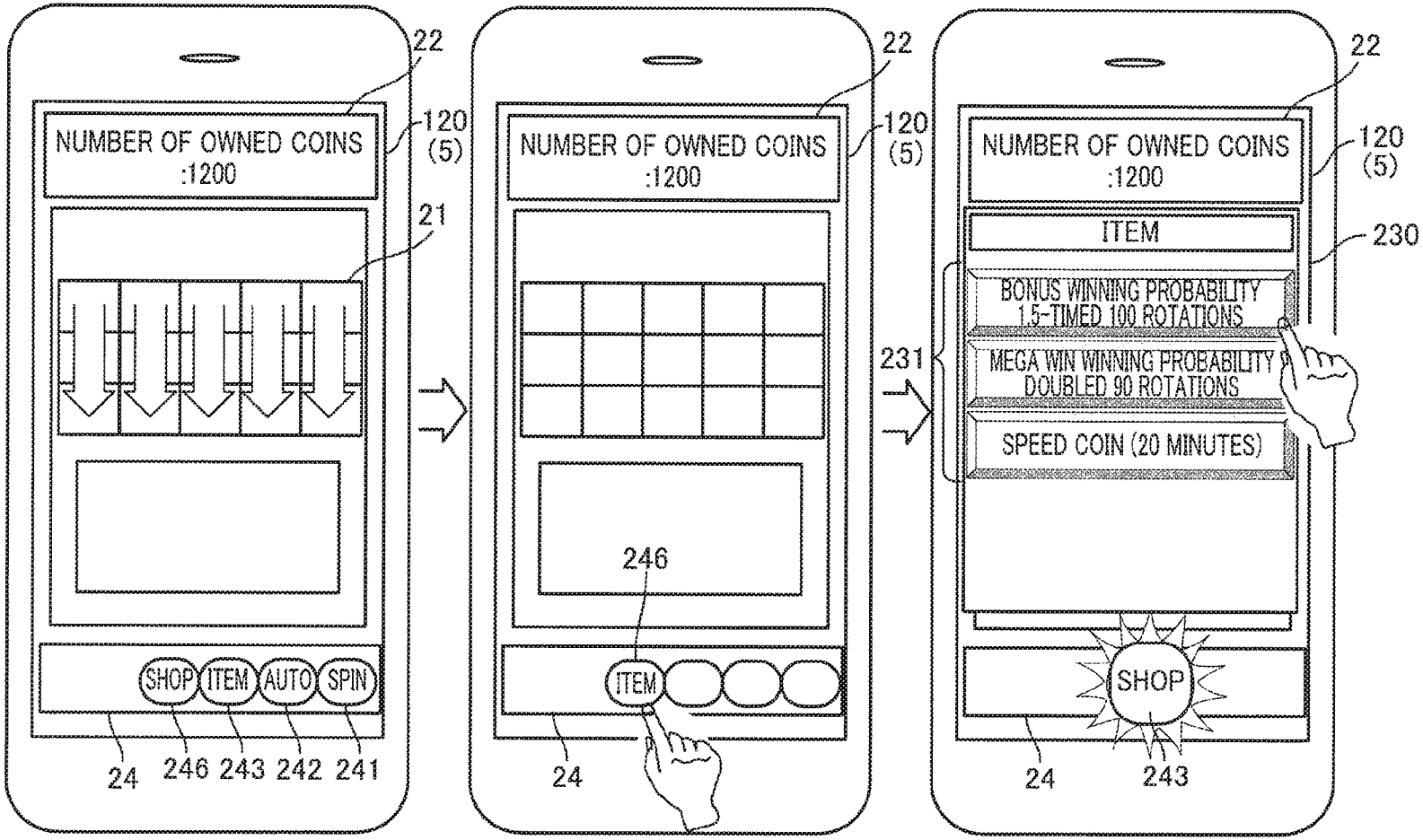
FIG. 12 illustrates how items displayed on the display are used.

The following will describe how items are used in the slot game of the present embodiment. In the present embodiment, for example, as shown in FIG. 12, after the end of the unit game in the slot game, etc., the player is allowed to touch an image of an ITEM button 243 in the operation display area 24 to display an item window 230 in which items owned by the player are displayed for selection. In the item window 230, as shown in FIG. 12, item icons 231 owned by the player are displayed. The player is allowed to select any of the item icons 231 to be used. For example, as shown in FIG. 12, when the item icon 231 corresponding to the item "BONUS Winning Probability 1.5 Timed 100 Rotations" is selected from the item icons 231, an effect of the use of the item "BONUS Winning Probability 1.5 Timed 100 Rotations" is exerted.

The obtained item such as "BONUS Winning Probability 1.5 Timed 100 Rotations" and "BIG WIN Winning Probability Doubled 100 Rotations" is stored in the flash memory 104 or the like (or in a storage device of the server 100 when the server 100 stores items). As the CPU 101 uses the item in the manner as described as above and executes the improved winning probability slot game control process, the CPU 101 functions as a setting unit which sets one of plural types of items (plural conditions).

In regard to the improved winning probability slot game control process of the present embodiment, a case where the item "BONUS Winning Probability 1.5 Timed 100 Rotations" is used will be described.

Figure 10:
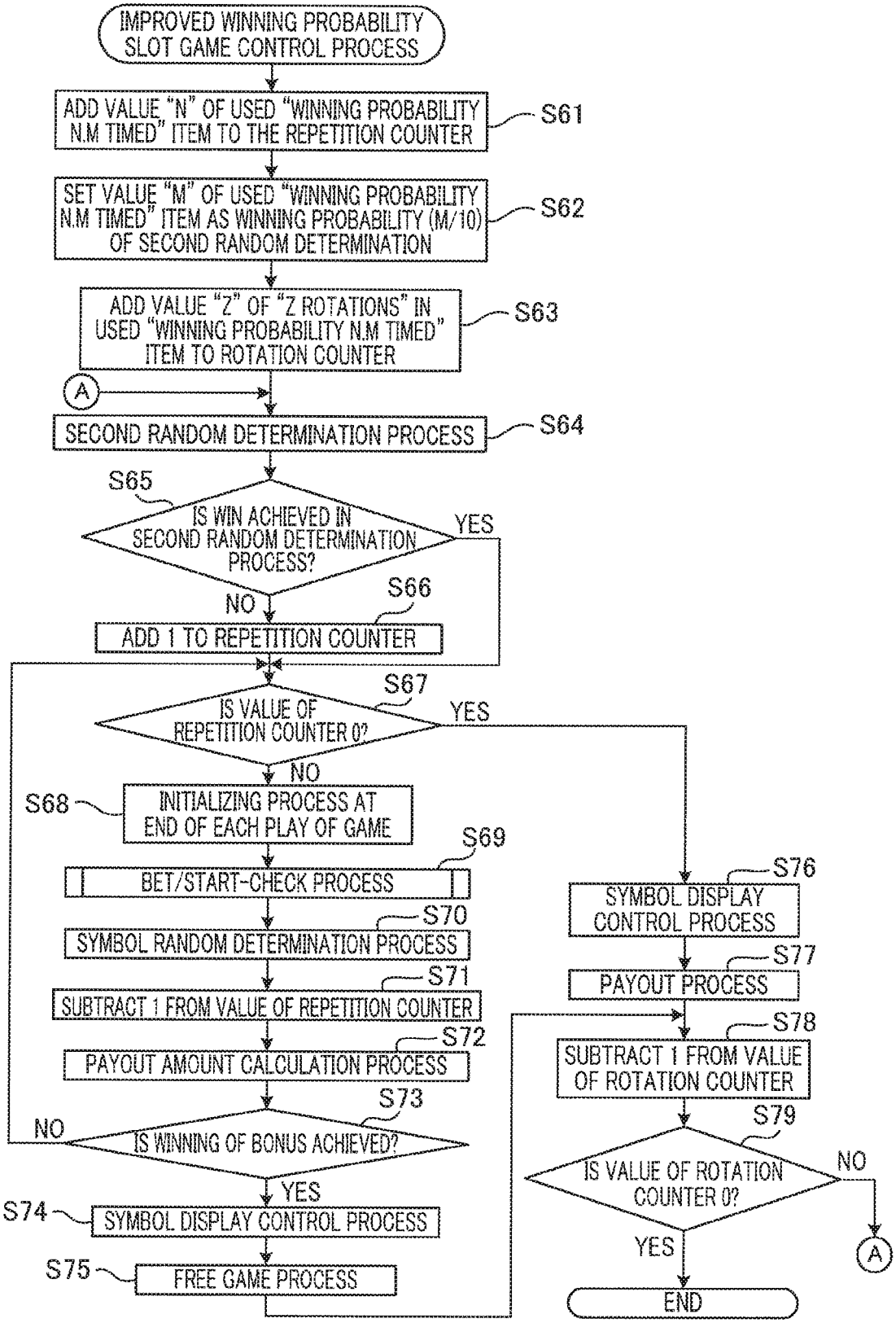
FIG. 10 shows a flowchart of an improved winning probability slot game control process.

As shown in FIG. 10, when the item "BONUS Winning Probability 1.5 Timed 100 Rotations" is used, the routine shifts to the improved winning probability slot game control process.

The shift to the improved winning probability slot game control process occurs, for example, when specific symbols (e.g., 4Kinds or more of "7") are rearranged as a combination in the normal slot game control process, when specific symbols specified by the game provider are rearranged in combination, or when a predetermine amount of money is paid.

When the improved winning probability slot game control process is executed, to begin with, the CPU 101 adds a value "1" which indicates an integral part of "Winning Probability 1.5 Timed" in the "BONUS Winning Probability 1.5 Timed 100 Rotations" to a repetition counter of the flash memory 104 (S61).

Furthermore, the CPU 101 sets a value "0.5" which indicates a fractional part of "Winning Probability 1.5 Timed" in the "BONUS Winning Probability 1.5 Timed 100 Rotations" as the winning probability of second random determination which is executed in a later-described second random determination process (S62). When a fractional part is 0 as in the case of "Winning Probability 2.0 Timed", the winning probability of the second random determination is set at 0. In other words, when a fractional part is 0, no win is achievable in the second random determination.

Furthermore, the CPU 101 adds a value "100" which corresponds to "100 Rotations" in the "BONUS Winning Probability 1.5 Timed 100 Rotations" to a rotation counter of the flash memory 104 (S63).

The CPU 101 then executes a second random determination process (S64). In this second random determination process, the random determination is executed based on the winning probability set in S62. For example, when the winning probability of the second random determination is set at 0.5 in S62, a win is achievable in the second random determination at the probability of 5/10.

Subsequently, whether a win is achieved in the random determination in the second random determination process in S64 is determined (S65). When a win is achieved in the second random determination (YES in S65), the CPU 101 adds 1 to the repetition counter of the flash memory 104 (S66).

After S66 or when no win is achieved in the second random determination (NO in S65), the CPU 101 determines whether the value of the repetition counter in the flash memory 104 is 0 (S67).

When the value of the repetition counter is not 0 (NO in S67), the CPU 101 executes an initializing process at the end of each play of the game (S68). For example, this process clears data in a working area of the flash memory 104, which becomes unnecessary at the end of each play of the unit game, e.g., WAYS BET activated in the previous execution of the unit game and symbols to be displayed on the symbol display area 21 as a result of random determination.

The CPU 101 then executes the above-described bet/start-check process (S69). In this process, the CPU 101 checks an input such as WAYS BET (WAYS BET1, WAYS BET2, WAYS BET3, WAYS BET4, or WAYS BET5) selected by using the touch panel 5, etc. At this stage, as shown in FIG. 4, an area which is selected as a subject of result determination in the symbol display area 21 on account of the selection of WAYS BET is shown in white, in order to differentiate such an area from areas (shown in black) which are not subjects of result determination. This makes it possible to visually discern an area which is a subject of result determination from an area which is not a subject of result determination.

Subsequently, the CPU 101 executes a symbol random determination process (S70). In this symbol random determination process, by using the symbol arrays of the video reels 3 shown in FIG. 6, to-be-stopped symbols are randomly selected from symbols provided on the symbol arrays (REEL1, REEL2, REEL3, REEL4, and REEL5) of the video reels. The to-be-stopped symbols are data of 5 symbols displayed in the middle stages of the first column area to the fifth column area of the symbol display area 21, among the symbols constituting the symbol arrays of the video reels 3. In this way, 15 symbols to be displayed in the symbol display area 21 are determined.

Subsequently, the CPU 101 subtracts 1 from the value of the repetition counter of the flash memory 104 (S71).

Subsequently, the CPU 101 executes a payout amount determination process (S72). In this process, based on the symbol combination table (see FIG. 7) stored in the flash memory 104, which win is achieved is determined based on 15 symbols to be displayed in the symbol display area 21, when the symbols form a predetermined number of linked symbols from the first column area to the fifth column area in the areas which are selected as subjects of result determination in the WAYS BET above. When a win is achieved, a payout corresponding to the achieved win is calculated. The CPU 101 stores the payout calculated in the payout amount determination process in a payout amount storage area of the flash memory 104. When no win is achieved and no payout is awarded, the payout is "0".

Subsequently, the CPU 101 determines whether a win of "BONUS" (3Kinds of "BONUS", 4Kind of "BONUS", or 5Kind of "BONUS") is achieved (S73). If the "BONUS" winning is not achieved (NO in S73), the process proceeds to S67.

When the "BONUS" winning is established (YES in S73), the CPU 101 executes a symbol display control process (S74). In this symbol display control process, the scroll of the symbol arrays of the video reels 3 starts. After a predetermined time elapses, the five to-be-stopped symbols selected in the symbol random determination process in S70 stop one by one in the middle stages of the first column area to the fifth column area of the symbol display area 21. In other words, 15 symbols including the to-be-stopped symbols are rearranged in the symbol display area 21. In this case, 15 symbols constituting the "BONUS" winning (3Kinds of BONUS, 4Kinds of BONUS, or 5Kinds of BONUS) are rearranged in the symbol display area 21.

The CPU 101 then executes a free game process (S75). This free game process allows the player to play the slot game without the consumption of coins, the number of times corresponding to the Kinds of the BONUS (10 times in 3Kinds of BONUS, 25 times in 4Kinds of BONUS, and 50 times in 5Kinds of BONUS).

Meanwhile, when the value of the repetition counter is 0 in S67 (YES in S67), the CPU 101 executes a symbol display control process (S76). In this symbol display control process, the scroll of the symbol arrays of the video reels 3 starts. After a predetermined time elapses, the five to-be-stopped symbols selected in the symbol random determination process in S70 stop one by one in the middle stages of the first column area to the fifth column area of the symbol display area 21. In other words, 15 symbols including the to-be-stopped symbols are rearranged in the symbol display area 21.

Subsequently, the CPU 101 executes a payout process (S77). To be more specific, the CPU 101 adds a value stored in the payout amount storage area of the flash memory 104 to the value of the coin counter provided in the flash memory 104. For example, when "500" is stored in the payout amount storage area in the payout amount determination process in S72, "500" is added to the value of the coin counter.

After S75 or S77, the CPU 101 subtracts 1 from the value of the rotation counter of the flash memory 104 (S78). To put it differently, the unit game is temporarily terminated.

The CPU 101 then determines whether the value of the rotation counter is 0 (S79). When the value of the rotation counter is not 0 (NO in S79), the process proceeds to S64. When the value of the rotation counter is 0 (YES in S79), the process is terminated.

In the above-described improved winning probability slot game control process, in S62, a value "0.5" which indicates a fractional part of "Winning Probability 1.5 Timed" in the used item "BONUS Winning Probability 1.5 Timed 100 Rotations" is set as the winning probability of second random determination. In this way, a process of (a) setting the winning probability of second random determination based on the winning probability corresponding to the condition set by a setting unit is executed. Furthermore, when a win is achieved in the second random determination process in S64, 1 is added to the repetition counter (S66) and the symbol random determination process equivalent to the first random determination is executed (S70). Because in the second random determination process the symbol random determination process equivalent to the first random determination is executed (S70), a process of (b) determining whether to execute the first random determination by the second random determination based on the winning probability set in the process (a) is executed. Furthermore, when a win is achieved in the second random determination process in S64, 1 is added to the repetition counter (S66) and the symbol random determination process equivalent to the first random determination is executed (S70). Therefore a process of (c) executing the first random determination when a win is achieved in the second random determination in the process (b) is executed. When BONUS is not won in the symbol random determination process in S70 (NO in S73), the routine goes back to S67, and the symbol random determination process (S70) is executed again when the value of the repetition counter is not 0. Therefore a process of (d) executing the first random determination again when a result of the first random determination in the process (c) is different from a predetermined result is executed.

In the unit game in which the execution of the symbol random determination process (first random determination) is selected in the second random determination process, when a result of the symbol random determination process is different from the winning of BONUS (predetermined result), the symbol random determination process is executed again to increase the probability of winning of the BONUS. Meanwhile, the winning probability in the second random determination process can be changed only by setting the multiplying factor (condition) by using an item. It is therefore unnecessary to modify the process itself, and the occurrence of a defect or the need of maintenance can be easily handled.

Furthermore, in the present embodiment, a value "0.5" which indicates a fractional part of "Winning Probability 1.5 Timed" in the used item "BONUS Winning Probability 1.5 Timed 100 Rotations" is set as the winning probability of second random determination. In this way, in the process (a), the winning probability of the second random determination is set based on a fractional part of the multiplying factor corresponding to the condition set by the setting unit. Furthermore, the value "N" corresponding to an integral part of "Winning Probability N.M Timed" in the used item "BONUS Winning Probability N.M Timed 100 Rotations" is added to the repetition counter (S61). Because the symbol random determination process (S70) equivalent to the first random determination can be executed N times, a process of (d) executing the first random determination the number of times corresponding to an integral part of the multiplying factor which corresponds to the condition set by the setting unit is executed.

When a multiplying factor (N.M timed) composed of an integral part N and a fractional part M is set by an item in order to increase the probability of BONUS winning (predetermined result) in the symbol random determination process (first random determination), second random determination (for determining whether to execute the symbol random determination process once) is additionally executed with the winning probability (M/10) which is set based on the fractional part (M) of the multiplying factor. With this arrangement, it is possible to execute a symbol random determination process with a multiplying factor less than one, while the same random determination as the symbol random determination process corresponding to the integral part is utilized.

To put it differently, a symbol random determination process with a multiplying factor having a fractional part is realized by a combination of two-staged random determinations, i.e., (i) repetition of the symbol random determination process the number of times corresponding to an integral part of a multiplying factor having been set and (ii) execution of the random determination process which is executed when it is determined in second random determination (with the winning probability based on a fractional part of the multiplying factor having been set) to execute the process.

Other Embodiments

While in the present embodiment the smartphone 1 shown in FIG. 1 is taken as an example of the information processor, the information processor of the present invention may be a server or a combination of a server and a mobile information device such as a smartphone which accesses to the server. In this case, the slot game is embodied as a social game. To be more specific, the application software of the slot game is executed on a web browser provided by a server, and the slot game is run in such a way that a mobile information device such a smartphone accesses to the web browser provided by the server.

Therefore, in the slot game, a touch input to a game screen displayed on a display of a mobile information device such as a smartphone is received by a web browser provided by a server. The server executes the programmed processes (the normal slot game control process, the bet/start check process, the improved winning probability slot game control process, etc.), and the execution process and the execution result are displayed on the display of the mobile information device such as a smartphone, via the Internet. In this case, a storing process in each process is executed in a storage device of the server.

In the description of the improved winning probability slot game control process in the embodiment above, when the BONUS is not won (NO in S73), the routine returns to S67. Alternatively, in this case, whether a payout calculated in the payout amount determination process (S72) is 20 to 40 times as much as the value of the bet counter (betted amount) may be determined. For example, when the payout calculated in the payout amount determination process is 500 and the value of the bet counter is 25, the multiplying factor is 20. This number falls within the range of 20 to 40, and hence the routine proceeds to S74.

In the improved winning probability slot game control process in the embodiment above, the second random determination is executed first with the winning probability corresponding to a fractional part of the "Winning Probability". Alternatively, the first random determination (symbol random determination process) may be executed the number of times corresponding to an integral part of the "Winning Probability", and when the predetermined benefit (BONUS winning) is not achieved after the repetition of the first random determination for the number of times corresponding to the integral part, the second random determination may be executed with the winning probability corresponding to a fractional part of the "Winning Probability", and the first random determination may be executed when a win is achieved in the second random determination.

The arrangement above is described below.

An information processor which executes a unit game in which a benefit is awarded based on a result of first random determination includes a controller which is programmed to execute the processes of:

(a) setting a multiplying factor including a fractional part based on a predetermined condition;

(b) repeating the first random determination the number of times corresponding to an integral part of the multiplying factor set in the process (a);

(c) when a predetermined benefit is not awarded as a result of the first random determination in the process (b), executing second random determination for determining whether to execute the first random determination again, based on the fractional part of the multiplying factor set in the process (a); and (d) executing the first random determination when it is determined in the second random determination that the first random determination is executed.

The embodiment above may be described as below.

An information processor which executes a unit game in which a benefit (e.g., a payout or BONUS winning) is awarded based on a result of first random determination includes a controller which is programmed to execute the processes of:

(a) setting a winning probability corresponding to a predetermined condition as a winning probability of second random determination;

(b) determining whether to execute the first random determination by the second random determination based on the winning probability set in the process (a);

(c) when a win is achieved in the second random determination in the process (b), executing the first random determination; and (d) when a predetermined benefit is not awarded as a result of the first random determination in the process (c), executing the first random determination again.

The embodiment above may be described as below.

An information processor which executes a unit game in which a benefit is awarded based on a result of first random determination includes a controller which is programmed to execute the processes of:

(a) setting a multiplying factor including a fractional part based on a predetermined condition;

(b) executing second random determination for determining whether to execute the first random determination, based on the fractional part of the multiplying factor set in the process (a);

(c) increasing the number of times of execution of the first random determination by one, when it is determined in the second random determination that the first random determination is executed; and (d) when the number of times of execution of the first random determination is increased by one in the process (c), causing the first random determination to be repeatable the number of times increased in the process (c).

In addition to the above, while in the present embodiment above the smartphone 1 shown in FIG. 1 is taken as an example of the information processor, the processes and actions of the smartphone 1 can be interpreted as those of a program or a game control method.

A specific control method is as follows.

A method of controlling a unit game in which a benefit is awarded based on a result of first random determination includes the steps of:

(a) setting a winning probability of second random determination based on a winning probability corresponding to a condition set by a setting unit which sets one of conditions associated with different winning probabilities, respectively;

(b) determining whether to execute the first random determination by the second random determination based on the winning probability set in the step (a);

(c) when a win is achieved in the second random determination in the step (b), executing the first random determination; and (d) when a result of the first random determination in the step (c) is different from a predetermined result, executing the first random determination again.

A specific program is as follows.

A non-volatile recording medium stores a game program, the game program causing an information processor, which executes a unit game in which a benefit is awarded based on a result of first random determination, to execute the processes of:

(a) setting a winning probability of second random determination based on a winning probability corresponding to a condition set by a setting unit which sets one of conditions associated with different winning probabilities, respectively;

(b) determining whether to execute the first random determination by the second random determination based on the winning probability set in the process (a);

(c) when a win is achieved in the second random determination in the process (b), executing the first random determination; and (d) when a result of the first random determination in the process (c) is different from a predetermined result, executing the first random determination again.

Embodiments of the present invention thus described above solely serve as specific examples of the present invention, and are not to limit the scope of the present invention. The specific structures and the like are suitably modifiable. Further, the effects described in the embodiments of the present invention described in the above embodiment are no more than examples of preferable effects brought about by the present invention, and the effects of the present invention are not limited to those described hereinabove.

What is claimed is:

1. An information processor which executes a unit game in which a benefit is awarded based on a result of first random determination, comprising:

a touchscreen display capable of displaying the unit game, the touchscreen display including a plurality of separate user selectable icons allowing execution of a normal unit game and an improved unit game having an improved winning probability relative to the normal game;

a controller including a central processing unit in communication with a memory storing computer executable instructions configured to program the controller to execute the unit game;

a non-transitory computer readable storage medium configured to store a plurality of game conditions associated with different winning probabilities a setting unit configured to set one of the plurality of game conditions associated with different winning probabilities stored in the non-transitory computer readable storage medium;

wherein, when the computer executable instructions are read by the controller, the controller is caused to execute the processes of:

displaying the unit game on the display screen;

(a) setting, by the setting unit, a winning probability of second random determination based on a winning probability associated with one of the plurality of game conditions;

(b) determining whether to execute the first random determination according to the second random determination based on the winning probability set in the process (a);

(c) when a win is achieved in the second random determination in the process (b), executing the first random determination; and (d) when a result of the first random determination in the process (c) is different from a predetermined result, executing the first random determination again.

2. The information processor according to claim 1, wherein, the setting unit is able to set a multiplying factor including a fractional part, in accordance with each of the conditions, in the process (a), the winning probability of the second random determination is set based on a fractional part of a multiplying factor corresponding to the condition which is set by the setting unit, and in the process (d), the first random determination is repeatable the number of times corresponding to an integral part of the multiplying factor corresponding to the condition which is set by the setting unit.

3. An information processor which executes a unit game in which a benefit is awarded based on a result of first random determination, comprising:

a touchscreen display capable of displaying the unit game, the touchscreen display including a plurality of separate user selectable icons allowing execution of a normal unit game and an improved unit game having an improved winning probability relative to the normal game;

a controller including a central processing unit in communication with a memory storing computer executable instructions configured to program the controller to execute the unit game;

a non-transitory computer readable storage medium configured to store a plurality of game conditions associated with different winning probabilities;

wherein, when the computer executable instructions are read by the controller, the controller is caused to execute the processes of:

(a) setting a multiplying factor including a fractional part based on a predetermined condition;

(b) repeating the first random determination a number of times corresponding to an integral part of the multiplying factor set in the process (a);

(c) when a predetermined benefit is not awarded as a result of the first random determination in the process (b), executing second random determination for determining whether to execute the first random determination again, based on the fractional part of the multiplying factor set in the process (a); and (d) executing the first random determination when it is determined in the second random determination that the first random determination is executed.

4. A method of controlling a unit game of a gaming device in which a benefit is awarded based on a result of first random determination, the gaming device including:

a touchscreen display capable of displaying the unit game, the touchscreen display including a plurality of separate user selectable icons allowing execution of a normal unit game and an improved unit game having an improved winning probability relative to the normal game;

a controller including a central processing unit in communication with a memory storing computer executable instructions configured to program the controller to execute the unit game;

a non-transitory computer readable storage medium configured to store a plurality of game conditions associated with different winning probabilities;

wherein, when the computer executable instructions are read by the controller, the controller executes the method comprising the steps of:

(a) setting a winning probability of second random determination based on a winning probability corresponding to a condition set by a setting unit which sets one of conditions associated with different winning probabilities, respectively;

(b) determining whether to execute the first random determination by the second random determination based on the winning probability set in the step (a);

(c) when a win is achieved in the second random determination in the step (b), executing the first random determination; and (d) when a result of the first random determination in the step (c) is different from a predetermined result, executing the first random determination again.

5. A non-volatile recording medium storing a game program executable by a gaming device including:

a touchscreen display capable of displaying a unit game of the game program, the executable game program configured to display a plurality of separate user selectable icons on the touchscreen display to allow execution of a normal unit game and an improved unit game having an improved winning probability relative to the normal game;

a controller including a central processing unit in communication with the non-volatile recording medium;

wherein, when the game program is read by the controller, the controller executes the a unit game in which a benefit is awarded based on a result of first random determination, to execute the processes of:

(a) setting a winning probability of second random determination based on a winning probability corresponding to a condition set by a setting unit which sets one of conditions associated with different winning probabilities, respectively;

(b) determining whether to execute the first random determination by the second random determination based on the winning probability set in the process (a);

(c) when a win is achieved in the second random determination in the process (b), executing the first random determination; and (d) when a result of the first random determination in the process (c) is different from a predetermined result, executing the first random determination again.

* * * * *